United States Patent [19]

Mougin

[11] 4,178,872

[45] Dec. 18, 1979

[54] MEMBER FOR ATTACHING A PROPULSION UNIT TO A TABULAR ICEBERG

[75] Inventor: Georges L. Mougin, Paris, France

[73] Assignee: ITI Limited, Paris, France

[21] Appl. No.: 877,844

[22] Filed: Feb. 15, 1978

[30] Foreign Application Priority Data

Apr. 14, 1977 [FR] France ..... 77 11276

[51] Int. Cl.[2] ..... B63H 21/30

[52] U.S. Cl. ..... 115/72; 405/217

[58] Field of Search ..... 114/270; 115/72, 76; 405/61, 217

[56] References Cited

U.S. PATENT DOCUMENTS 3,990,253 11/1977 Lea, Jr. et al. ..... 405/217

OTHER PUBLICATIONS

Cooper, Larry M. "Iceberg Farming: A New Supply of Fresh Water?" Ocean Industry, Mar. 1973; pp. 28, 29.

*Primary Examiner*—Jesus D. Sotelo

*Attorney, Agent, or Firm*—George E. Kersey

[57] ABSTRACT

A member in the form of a ring connected by radial fins to central hub includes a heater at least for its lower surfaces so that in operation it melts the ice of the iceberg (starting from the top surface thereof) and sinks therethrough with the ice re-freezing above it. The member also includes a central tube removeably attached to the central hub. The tube is fed after the sinking member to provide a vertical shaft through the iceberg. The ring serves to remove a slab of larger diameter than the tube from the lower surface of the iceberg in order to receive a propulsion unit.

15 Claims, 3 Drawing Figures

-16-

MEMBER FOR ATTACHING A PROPULSION UNIT TO A TABULAR ICEBERG

The present invention concerns the attachment of propulsion units to the substantially horizontal lower surfaces of tabular icebergs, such as are found only in Antarctic waters.

In the Antarctic the ice does not advance in the form of tongues but forms a plateau with a well-defined frontier where it meets the ocean. The Antarctic continent is not encircled by mountains, but is bordered by a sheet of ice, part of which is supported on the continental shelf and the rest of which floats upon the surface of the ocean. Under the pressure of the ice inland, this mass of ice is gradually pushed towards the sea, and from time to time tabular icebergs become detached from the ice plateau. Although these can have areas of several square kilometers, they can be towed to the coastal waters of the arid regions of the earth. Towing a tabular iceberg from the Antarctic to the northern hemisphere at a speed of 0.5 meters per second takes several months, however, and is far from straight-forward, in particular because of the number of tugs needed and the limited periods of autonomy available from the tugs (generally about one month). In such circumstances there is an interest in fitting electric propulsion units beneath the iceberg, and in supplying them with electrical power generated by an installation on the iceberg itself.

The height of the submerged portion of a rectangular tabular iceberg is six to eight times the height of the portion above sea level, and the total thickness of the iceberg may be some 250 to 300 meters.

The present invention is intended to provide a member intended to pass through an iceberg by melting the ice thereof and then to serve as a device for the attachment of underwater propulsion units with horizontal or vertical axes. In the first case the screw is located within a shroud, and in the second case the propulsion unit is of the "Voith-Schneider" type.

The invention also comprises the methods of installing the member in the mass of the iceberg, in the vicinity of the substantially horizontal lower surface thereof, and of attaching a propulsion unit.

A member for attaching an underwater propulsion unit to the substantially horizontal surface of a tabular iceberg floating in the sea comprises a removable nose at the end of a central tube passing through the thickness of the iceberg and attached to a ring by fins. All of the component parts of the member are of negligible thickness in comparison with the diameter of the ring.

In accordance with one embodiment of the invention, the fins attaching the ring to the central tube are in two parts, comprising a fixed part which attaches the ring to the central tube and a movable, heated lower edge part, which can be rotated about the central tube to cut out an ice disc defined by the ring, the sea in which the iceberg is floating, and the lower edges of the fins.

At least the ring and the fins have vertical grooves parallel to the central tube on those surfaces with generatrices parallel to the central tube. As the member descends through the iceberg under its own weight by melting the ice of the iceberg, the ice melted beneath the member passes to a position above the torpedo where it refreezes. To this end, the walls of the member with generatrices parallel to the central tube are heated less intensely than the lower edges of the ring and the fins and the end of the removable nose. A pump is located at the lower end of the central tube for pumping up to the upper surface of the iceberg a volume of melted ice corresponding to the volume of the central tube.

When the member comes into contact with the sea, the removable nose is intensely heated in order to melt the ice between it and the ring. Another way of removing the ice contained between the ring and removable nose consists in cutting out a ring of ice. To this end the lower edge portions of the fins connecting the ring to the central tube are capable of rotating about the central tube through an angle of at least 120°. These lower edge portions of the fins are rotated by a shaft passing through the central tube, and are heated so that as they rotate they cut away an ice disc attached to the removable nose of the central tube and forming with this removable nose and the lower edge portions of the fins an assembly whose density is greater than that of the seawater in which the iceberg is floating. After cutting away the ice disc by rotating the heated lower edge portions of the fins, the assembly comprising the ice disc, the lower edge portions of the fins and the removable nose descends towards the ocean floor to leave a space inside the ring for receiving the conical dome of the propulsion unit.

A member in accordance with the invention is intended to be installed through the thickness of a tabular iceberg. The ice of the iceberg is melted beneath the lower edges of the component parts of the member (the central tube, the removable nose, the ring and the fins attaching the ring to the central tube), the member sinks through the iceberg under its own weight, displacing the melted ice through the grooves in the walls of its component parts to a position above the member, where it refreezes, a volume of melted ice equal to the volume of the central tube being pumped to the upper surface of the iceberg, the upper end of the central tube being temporarily retained on the upper surface of the iceberg when the removable nose reaches the sea, the central tube having been progressively lengthened by the addition of sections as the member sinks through the iceberg, and the ice between the ring and the removable nose being removed by heating the latter. The descent of the member must be interrupted for a period sufficient to allow the melted ice to refreeze following interruption of the heating of the member.

At least three suspension cables and one electrical power cable temporarily attached to the removable nose are passed through the central tube. The central tube may also contain a vertical shaft driving the lower edge portions of the fins attaching the ring to the central tube. This vertical shaft may also drive an underwater propulsion unit beneath the substantially horizontal lower surface of the iceberg. In this case, the drive machinery is located on the substantially horizontal surface of the iceberg, which facilitates its maintenance.

The attachment of an underwater propulsion unit to the substantially horizontal lower surface of an iceberg by means of a member in accordance with the invention comprises six stages, as follows: the member is passed down through the iceberg by melting the ice thereof, the ice between the ring and the removable nose of the member is removed, the removable nose is lowered to a depth beneath the lower surface of the iceberg greater than the sum of the distance of the member from the edge of the iceberg and the draught of the iceberg, the removable nose is drawn out from beneath the iceberg by hooking it up with a cable drawn by, for example, two tugs, the removable nose is recovered, and a propulsion unit is substituted for the removable nose at the end of the cables passing through the central tube, lowered beneath the iceberg, and located with a conical dome engaged in the ring of the member by a process which is known per se.

The propulsion unit may be recovered using a method which is the opposite of that by which it is installed: the propulsion unit is lowered on the end of a security cable which is hooked up by a cable drawn, for example, by two tugs, so as to draw the propulsion unit out from beneath the iceberg, the propulsion unit then being raised to the surface and recovered.

The member itself can be recovered after the propulsion unit is recovered or with the propulsion unit still attached to it. The upper end of the central tube is released from the retaining means on the upper surface of the iceberg and the member is heated so that it descends under its own weight on the end of a security cable which is hooked up by a cable drawn, for example, by two tugs, so as to draw the member out from beneath the iceberg, the member then being raised to the surface and recovered.

The invention will now be described in more detail and by way of example only, with reference to the accompanying diagrammtic drawings, in which.

Figure 1:
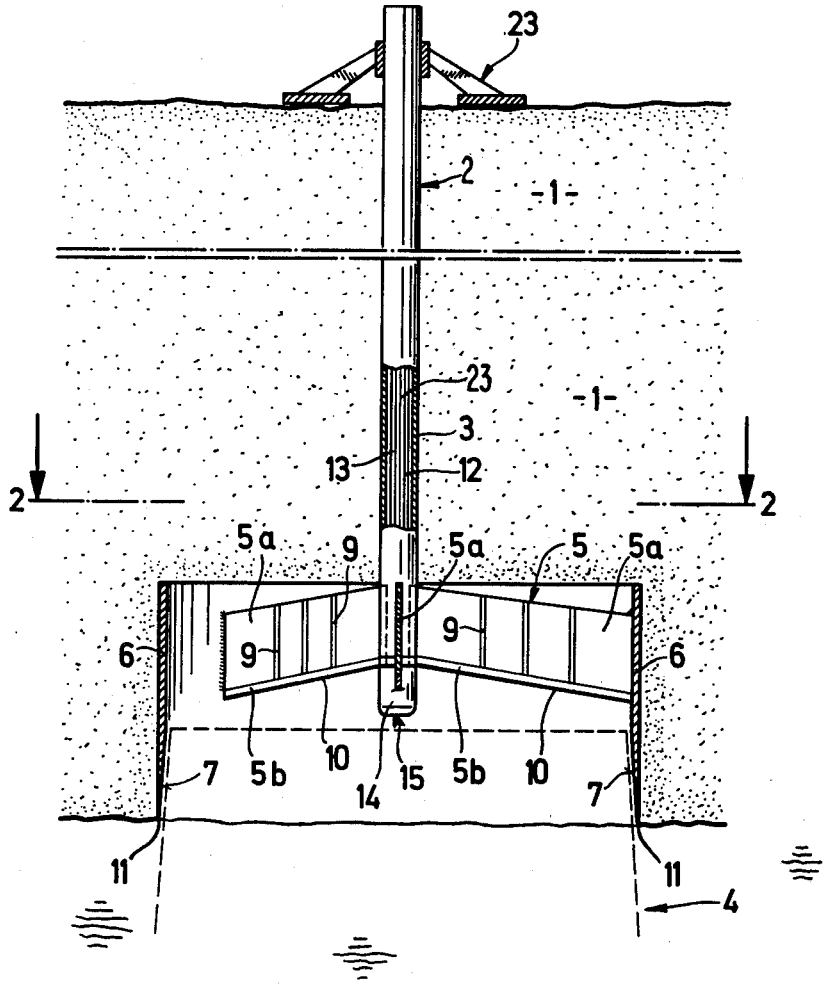
FIG. 1 is a vertical cross-section through a member in accordance with the invention lodged in an iceberg.

FIG. 1 represents a cross-section through an iceberg (1) and a member (2) which basically consists of a central tube (3) with a diameter of about 10 centimeters. The central tube (3) passes right through the iceberg (1) and has at its upper end retaining means for preventing it slipping downwards, which would result in the loss of the member (2) and the propulsion unit (4) shown in dashed outline. The central tube (3) is formed from a number of segments fixed end-to-end, and has at its lower end three fins (5) connecting it to a ring (6) which has a diameter of several meters and a thickness of a few tens of centimeters. The inside surface (7) of the lower portion of the ring (6) has the shape of a hollow cone and is intended to receive the conical dome of the propulsion unit (4).

Figure 2:
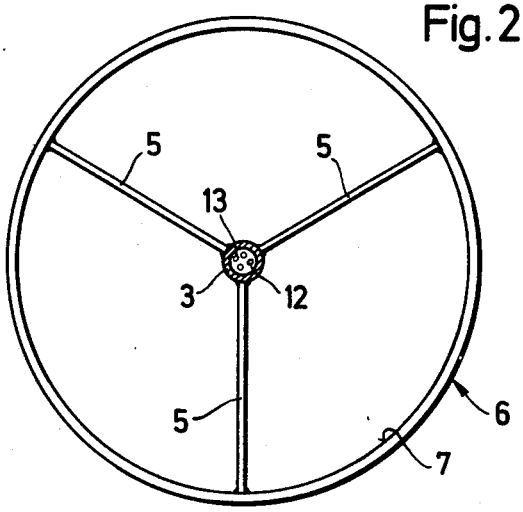
FIG. 2 is a plan view of the lower portion of the member shown in FIG. 1.

FIG. 2 is a plan view of a member in accordance with the invention. In the centre is the central tube (3) connected to the ring (6) by the fins (5). The surfaces of the fins (5) and the ring (7) include vertical grooves (9) designed to facilitate the flow of melted ice. The ice of the iceberg (1) is melted by electrical resistances embedded within the ring (6) and fins (5) and not shown in the drawing. If necessary the heat may be distributed by means of oil. The rate of heating is maximum at the lower edges (10 and 11) of the fins (5) and the ring (6).

The central tube (3) contains electrical power cables (13) and suspension cables (12) which are used in installing the propulsion unit (4). The removable nose (14) of the central tube (3) is temporarily attached to these cables, and has attached to it a flotation unit which can be inflated by compressed air or by means of a pyrotechnic generator. The removable nose (14) of the central tube (3) of the member (2) also contains a pump (15) and a heating resistance.

When the member is placed on the horizontal upper surface of the iceberg (1) and the heating resistances in the fins (5), the removable nose (14) and ring (6) of the member (2) are connected to a source of voltage, the heat generated melts the ice in contact with the edges (10 and 11) and the end (15) of the removable nose (14). The member (2) therefore sinks into the ice under its own weight. The central tube (3) is extended by the addition of sections as the member (2) sinks through the iceberg (1) and its walls are gently heated in order to facilitate its passage through the ice. The pump (15) located in the removable nose (14) of the member (2) pumps a volume of melted ice corresponding to the volume occupied by the central tube (3) to the upper surface of the iceberg, where it is pumped into the sea (16) on which the iceberg (1) is floating or stored for future use. The melted ice corresponding to the volumes occupied by the ring (6) and the fins (5) passes through the grooves (9) in the walls of the ring (6) and the fins (5), under the effect of the pressure exerted by virtue of the weight of the member (2), to a position above the member (2). This water refreezes above the member (2) as the member descends through the iceberg (1).

The progress of the member (2) through the iceberg (1) is followed by means of a conventional ultrasonic device. When the edge (11) of the ring (6) reaches the lower surface of the iceberg (1), the member (2) is prevented from moving downwards by the retaining means (23) attached to the upper end of the central tube (3) and bearing on the upper surface of the iceberg (1). Thus the member (2) is suspended by virtue of the retention of the central tube (3) at the surface of the iceberg. It only remains to remove the ice contained between the ring (6) and the removable nose (14).

In a first embodiment of the invention, the heating effect is then concentrated in the removable nose (14) of the central tube (3) of the member (2) so as to melt the ice between the ring (6) and the removable nose (14), which frees the hollow cone in which the dome (8) of the propulsion unit (4) is to be engaged of ice. In a second embodiment of the invention, the fins (5) connecting the ring (6) to the central tube (3) are in two parts, comprising the fin proper (5*a*) which connects the ring (6) to the central tube (3), and the lower edge (5*b*) of said fin (5*a*) which can be rotated about the central tube (3) through a vertical shaft 23 to remove the ice contained between the ring (6) and the removable nose (14) of the central tube (3). The heating of the lower edges (5*b*) of the fins (5) as they are rotated about the central tube (3) melts the ice of the iceberg (1) so as to cut out an ice disc defined by the ring (6), the sea (16) and the lower edges (5*b*) of the fins (5). The removable nose (14) of the central tube (3) of the member (2), the lower edge portions (5*b*) of the fins (5) and this ice disc together form an assembly whose mean density is higher than that of the seawater (16) in which the iceberg (1) is floating. This assembly therefore descends towards the ocean bed. It should be noted that the heated and mobile edge portions (5*b*) cut out a conical ice disc, at the summit of which is embedded the removable nose (14) of the central tube (3). The conical form of the inside surface (7) of the lower portion of the ring (6) not only facilitates the installation of the conical dome of the propulsion unit (4), but also facilitates the removal of the ice disc.

Figure 3:
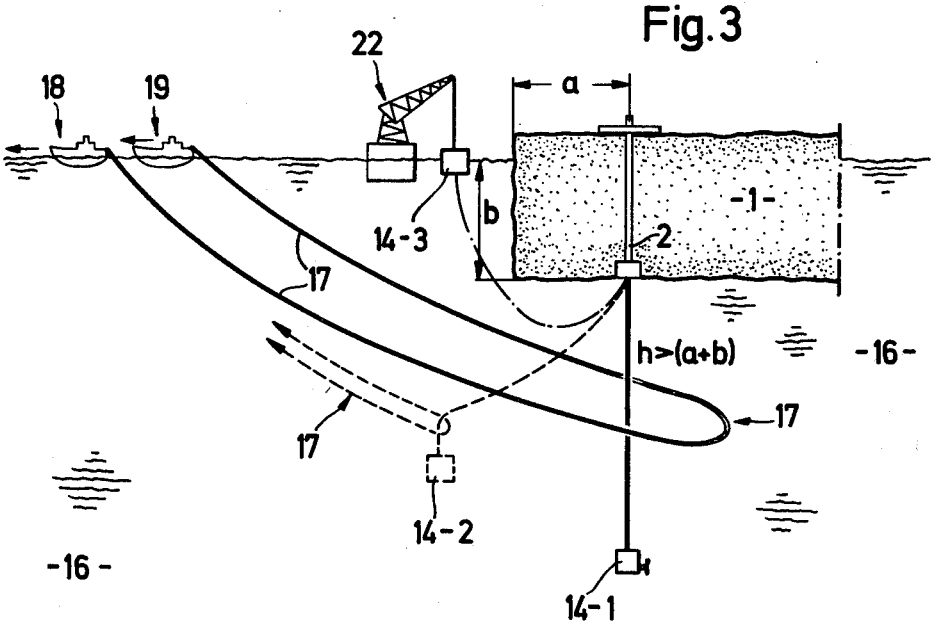
FIG. 3 illustrates the method of installing a propulsion unit beneath a tabular iceberg.

The three suspension cables (12) and the electrical power cables (13) attached to the removable nose (14) are then paid out so as to lower said nose (14) through a distance greater than the sum of the distance of the member (2) from the edge of the iceberg (1) and the draught of the iceberg (1) (position 14-1). A cable (17) drawn by two tugs (18 and 19) draws the removable nose (14) out from below the iceberg (1), as shown in FIG. 3. When the removable nose (14) is no longer beneath the iceberg (1) (position 14-2), a flotation unit inflated by compressed air or by means of a pyrotechnic generator brings the removable nose (14) to the surface (position 14-3). The removable nose (14) is then recovered, and the various cables are attached to the propulsion unit (4) which is lowered into the water by means of a floating crane (22). The propulsion unit (4) is then installed using, for example, the techniques developed by the Swedish company KARLSTADS MEKANISKA WERKSTAD. These techniques are well-known in the installation of propulsion units beneath the legs of semi-submersible drilling platforms. The propulsion units may be driven via a vertical shaft from machinery located on the substantially horizontal upper surface of the iceberg (1).

The propulsion units (4) may be recovered using a method which is the reverse of the installation method: it is lowered, then hooked up and drawn up from beneath the iceberg (1), and finally raised to the surface. Likewise, the member (2) may be recovered, after recovery of the propulsion unit (4) or with the latter attached to it, by attaching the central tube (3) to a security cable and releasing its upper end. The member (2) is then heated to melt the ice around it, and descends towards the sea bed, on the end of the security cable. It can then be hooked up by means of a cable drawn by tugs and drawn out from beneath the iceberg (1), raised to the surface and recovered.

The claims defining the invention are as follows:

1. A member for attaching an underwater propulsion unit to the substantially horizontal lower surface of a tabular iceberg, the member comprising a central tube and a ring attached to a central hub by fins, the hub forming a removable nose of the central tube which serves for lining a bore made through the iceberg by operation of the member, and the torpedo including heating means whereby, in operation, it melts the ice of the iceberg and sinks therethrough with the ice re-freezing above it.

2. A member according to claim 1, wherein its component parts, the central tube, the removable nose, the ring and the fins attaching the ring to the central tube, are of negligible thickness in comparison with the diameter of the ring.

3. A member according to claim 1 wherein at least the ring and the fins have grooves in those of their surface which are generally vertical, in operation, in order to facilitate the flow of melted water from the lower to the upper edges of the ring and the fins.

4. A member according to claim 1, wherein the heating means heat the lower edges of the ring and fins and the end of the removable nose, and also heat the sides of the ring and the fins, but to a lesser degree than the said lower edges.

5. A member according to claim 1 including a pump located at the lower end of the central tube for pumping up to the upper surface of the iceberg a volume of melted ice corresponding to the volume of the central tube.

6. A member according to claim 1 wherein the heating means is arranged, when the member comes into contact with the sea, to heat the removable nose intensely in order to melt the ice between the nose and the ring.

7. A member according to claim 1 wherein the fins attaching the ring to the central tube are in two parts, comprising a fixed part which attaches the ring to the central tube and a movable, heated lower edge part, which can be rotated about the central tube to cut out an ice disc defined by the ring, the sea in which the iceberg is floating, and the lower edges of the fins.

8. A member according to claim 7, wherein said ice disc forms, with the removable nose of the central tube and the lower edge portions of the fins, an assembly whose density is greater than that of the seawater in which the iceberg is floating.

9. A member according to claim 7 including a vertical shaft for driving the lower edge portions of the fins attaching the ring to the central tube.

10. A member according to claim 1 wherein at least three suspension cables and one electrical power cable are temporarily attached to the removable nose and are passed to it through the central tube.

11. A method of embedding a member in an iceberg, comprising the steps of (a) melting the ice of the iceberg beneath the lower edges of said member;

(b) allowing the member to sink into the iceberg under its own weight;

(c) pumping a volume of melted ice equal to the volume of the melted ice to the upper surface of the iceberg; and (d) progressively lengthening the member by the addition of sections as the member sinks into the iceberg.

12. The method of claim 11 further including the step of retaining the uppermost section of said member on the upper surface of the iceberg when the said member has melted therethrough.

13. The method of claim 11 further including the steps of (e) providing a removable nose on said member and lowering it below the lower surface of the iceberg; and (f) withdrawing the removable nose from beneath the iceberg by hooking it with a cable and substituting a propulsion unit therefor on cables passing through said member.

14. The method of claim 13 wherein the propulsion unit subsequently is lowered on the end of a security cable to move it away from the lower surface of the iceberg.

15. The method of claim 13 wherein an upper end of the member is released on the upper surface of the iceberg and the remainder of the member is heated so that it descends under its own weight on the end of a security cable and is drawn out from beneath the iceberg, after which it is raised to the surface and recovered.

* * * * *